United States Patent [19]

Williams et al.

[11] Patent Number: 5,031,251

[45] Date of Patent: Jul. 16, 1991

[54] ACCORDIAN TOILET FOR AMPUTEES

[76] Inventors: Rev G. H. Williams, 3645 Mercer University, DR Macon, Ga. 31204; George Spector, 233 Broadway, New York City, N.Y. 10007

[21] Appl. No.: 527,427

[22] Filed: May 23, 1990

[51] Int. Cl.[5] ..... E03D 11/00

[52] U.S. Cl. ..... 4/420; 4/252 R; 4/312; 4/480; 4/645; 297/330; 297/DIG. 10

[58] Field of Search ..... 4/420, 252 R, 251, 312, 4/645, 566, 645, 563, 564, 561; 297/330, DIG. 10, DIG. 3, 311, 480

[56] References Cited

U.S. PATENT DOCUMENTS

| | | | |
|---|---|---|---|
| 2,428,462 | 10/1947 | Levin | 4/312 |
| 2,527,270 | 10/1950 | Levin | 4/312 |
| 4,091,473 | 5/1978 | Matthews et al. | 4/251 X |
| 4,168,552 | 9/1979 | Austin | 4/251 X |
| 4,174,546 | 11/1979 | Ohtake | 4/252 R X |
| 4,185,335 | 1/1980 | Alvis | 4/251 |
| 4,726,079 | 2/1988 | Signori | 4/252 R |
| 4,920,587 | 5/1990 | Kerr | 4/480 |
| 4,947,493 | 8/1990 | Solonica | 4/480 X |

*Primary Examiner*—Henry K. Artis

[57] ABSTRACT

A height adjustable toilet for a handicapped person is provided and consists of a mechanism connected to a toilet bowl for selectively raising and lowering the height of its rim portions with respect to the floor, thereby causing an accordion pedestal portion and an extendable flush pipe to lengthen and shorten accordingly so that the handicapped person can conveniently sit upon and get off of a toilet seat on the rim portion of the toilet bowl.

2 Claims, 1 Drawing Sheet

ACCORDIAN TOILET FOR AMPUTEES

BACKGROUND OF THE INVENTION

The instant invention relates generally to plumbing fixtures and more specifically it relates to a height adjustable toilet.

Numerous plumbing fixtures have been provided in prior art that are adapted to be of fixed heights and be both the terminals of the water supply and the beginnings of the sewage systems which control to a large extent both the quantity of water that must be furnished and the amount of sewage that must be carried away. While these units may be suitable for the particular purpose to which they address, they would not be as suitable for the purposes of the present invention as heretofore described.

SUMMARY OF THE INVENTION

A primary object of the present invention is to provide a height adjustable toilet that will overcome the shortcomings of the prior art devices.

Another object is to provide a height adjustable toilet that is designed primarily for a handicapped person who finds it rather difficult to sit upon and to get off of a toilet seat such as on a standard toilet.

An additional object is to provide a height adjustable toilet in which the pedestal portion of the toilet bowl is of an accordion type so that the height of the rim portion may go up and down for the convenience of the handicapped person.

A further object is to provide a height adjustable toilet that is simple and easy to use.

A still further object is to provide a height adjustable toilet that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figures 1, 2, 3, 4, 5, 6, 7:
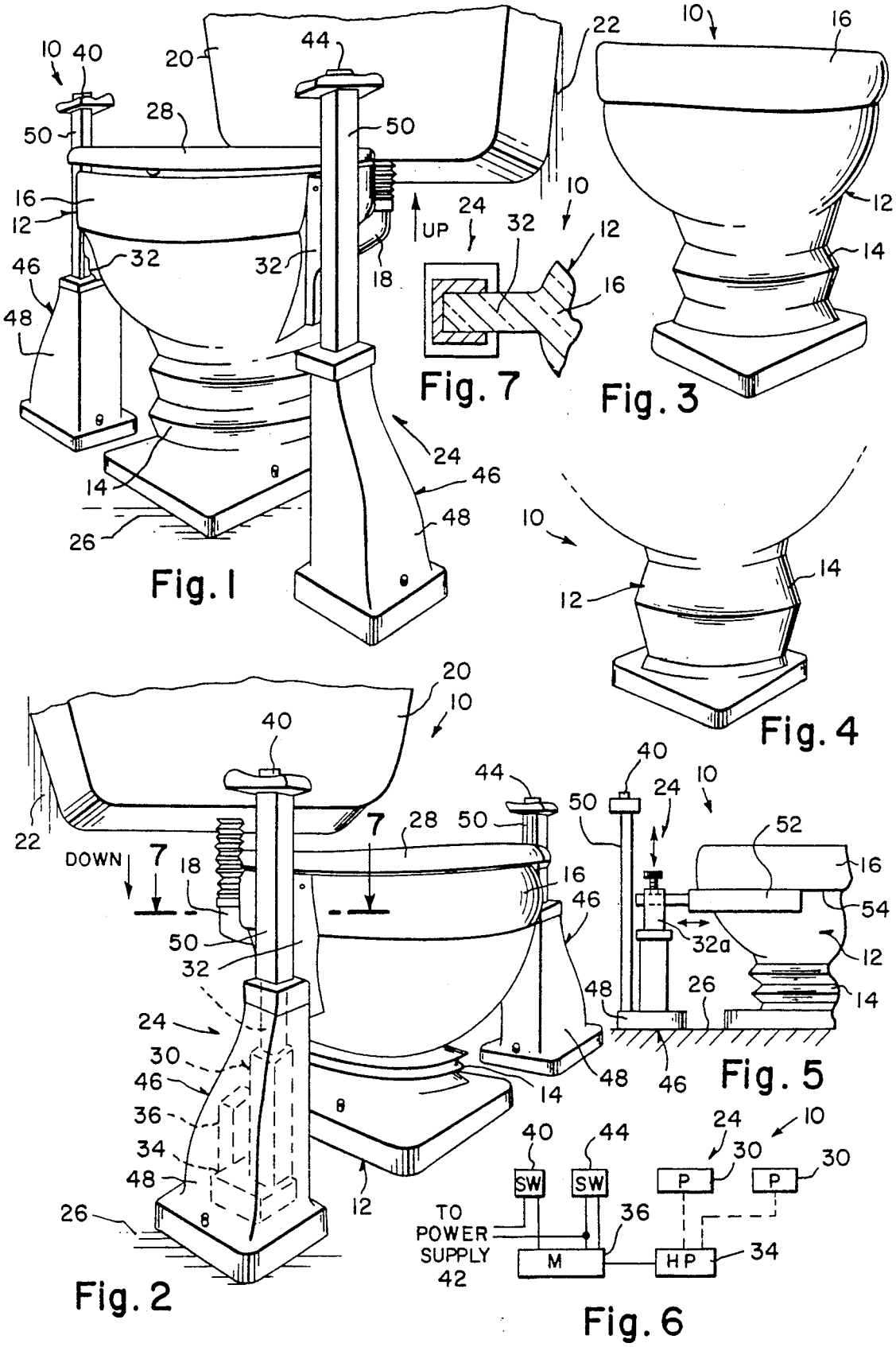
FIG. 1 is a perspective view of the invention in an up position.
FIG. 2 is a perspective view of the invention in a down position.
FIG. 3 is a perspective view of the toilet bowl with another type of accordion pedestal portion.
FIG. 4 is a perspective view of the toilet bowl with still another type of accordion pedestal portion.
FIG. 5 is a side view with parts broken away of a modification in which a C-shaped longitudinally adjustable holding member on the piston arm is provided to raise and lower the rim portion of the toilet bowl.
FIG. 6 is a block diagram of the electrical circuit of the invention.
FIG. 7 is a cross sectional view taken along line 7—7 in FIG. 2, showing the piston arm in greater detail.

Turning now descriptively to the drawings, in which similar reference characters denote similar elements throughout the several views, the figures illustrate a height adjustable toilet 10 for a handicapped person. The toilet 10 contains a toilet bowl 12 that has an accordion pedestal portion 14 and a rim portion 16. An extendable flush pipe 18 is fluidly connected between a toilet tank 20, stationary mounted to a wall 22 and the toilet bowl 12. A mechanism 24 is provided, which is connected to the toilet bowl 12, for selectively raising and lowering the height of the rim portion 16 with respect to the floor 26. The mechanism 24 causes the accordion pedestal portion 14 and the extendable flush pipe 18 to lengthen and shorten accordingly, so that the handicapped person can conveniently sit upon and get off of a toilet seat 28.

The mechanism 24 includes a pair of hydraulic pistons 30, each having a piston arm 32 cooperating with one opposite side of the rim portion 16 of the toilet bowl 12. A pump 34 is hydraulically connected to the pistons 30 while a motor 36 is electrically connected to the pump 34. A first control switch 40 is electrically connected between the motor 36 and a power supply 42, such as house current or the like, to operate the motor 36 which activates the pump 34 so that each piston 30 will raise its respective piston arm 32 into an up position. A second control switch 44 is also electrically connected between the motor 36 and the power supply 42 to operate the motor 36 which activates the pump 34 so that each piston 30 will lower its respective piston arm 32 into a down position.

A pair of stanchions 46, each having a base support portion 48 and a support arm portion 50 are spaced apart on opposite sides of the toilet bowl 12. One of the stanchions 46 carries one of the pistons 30, the pump 34, the motor 36 and the first control switch 40. The other stanchion 46 carries the other piston 30 and the second control switch 44.

FIG. 5 shows a modified piston arm 32*a* which includes a C-shaped longitudinally adjustable holding member 52 that engages with bottom lip 54 of the rim portion 16 of the toilet bowl 12. The holding member 52 can raise and lower the rim portion 16 with respect to the floor 26.

To operate the height adjustable toilet 10, the handicapped person simply presses the second control switch 44 to lower the rim portion 16 of the toilet bowl 12 so that the toilet seat 28 can be reached to sit upon. The handicapped person now presses the first control switch 40 to raise the rim portion 16 of the toilet bowl to its normal height. When the handicapped person is finished using the toilet 10, the second control switch 44 is pressed again to lower the rim portion 16 of the toilet bowl 12 so that the handicapped person can get off the toilet seat 28.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A height adjustable toilet for a handicapped person which comprises:

(a) a toilet bowl having an accordion pedestal portion and a rim portion;

(b) an extendable flush pipe fluidly connected between a stationary toilet tank mounted to a wall and said toilet bowl; and (c) means connected to said toilet bowl for selectively raising and lowering the height of said rim portion with respect to the floor, thereby causing said accordion pedestal portion and said extendable flush pipe to lengthen and shorten accordingly so that the handicapped person can conveniently sit upon and get off of a toilet seat on said rim portion of said toilet bowl, wherein said raising and lowering means includes:

(d) a pair of hydraulic pistons, each having a piston arm cooperating with one opposite side of said rim portion of said toilet bowl;

(e) a pump hydraulically connected to said pistons;

(f) a motor electrically connected to said pump;

(g) a first control switch electrically connected between said motor and a power supply to operate said motor which activates said pump so that each said piston will raise said respective piston into an up position; and (h) a second control switch electrically connected between said motor and the power supply to operate said motor which activates said pump so that each said piston will lower said respective piston into a down position; further comprising a pair of stanchions each having a base portion and support arm portion which are spaced apart on opposite sides of said toilet bowl in which one of said stanchions carries one of said pistons, said pump, said motor and said first control switch, while other of said stanchions carries the other of said pistons and said second control switch.

2. A height adjustable toilet as recited in claim 1, wherein each said piston arm further includes a C-shaped longitudinally adjustable holding member so as to engage beneath said rim portion of said toilet bowl to raise and lower said rim portion with respect to the floor.

* * * * *